United States Patent [19]

Walsh

[11] 4,249,101

[45] Feb. 3, 1981

[54] INCANDESCENT LAMP WITH INFRARED REFLECTING-VISIBLE ENERGY TRANSMITTING COATING AND MISALIGNED FILAMENT

[75] Inventor: Peter Walsh, Stirling, N.J.

[73] Assignee: Duro-Test Corporation, North Bergen, N.J.

[21] Appl. No.: 952,267

[22] Filed: Oct. 18, 1978

[51] Int. Cl.[3] ..... H01K 1/18; H01K 1/32

[52] U.S. Cl. ..... 313/112; 313/113; 313/271; 313/315

[58] Field of Search ..... 313/112, 113, 114, 271, 313/315, 222

[56] References Cited

U.S. PATENT DOCUMENTS

| | | | |
|---|---|---|---|
| 1,239,371 | 9/1917 | Evans | 313/222 X |
| 1,342,894 | 6/1920 | Bugbee | 313/114 X |
| 2,121,314 | 6/1938 | Birdseye et al. | 313/114 |
| 3,209,188 | 9/1965 | Freeman | 313/315 X |
| 3,209,192 | 9/1965 | Decker | 313/222 X |
| 3,253,178 | 5/1966 | Fantur | 313/271 |
| 3,974,370 | 8/1976 | Pearson | 313/49 |
| 4,039,878 | 8/1977 | Eijkelenboom et al. | 313/112 X |

*Primary Examiner*—Palmer C. Demeo
*Attorney, Agent, or Firm*—Darby & Darby

[57] ABSTRACT

An incandescent electric lamp having an envelope and means for reflecting infrared energy back to the filament to increase its operating temperature while transmitting visible energy. The envelope is shaped to reflect the infrared energy back to the filament and the filament is purposely misaligned with respect to the optical center of the envelope so that the infrared energy impinges on the filament after two reflections from the envelope wall.

11 Claims, 4 Drawing Figures

INCANDESCENT LAMP WITH INFRARED REFLECTING-VISIBLE ENERGY TRANSMITTING COATING AND MISALIGNED FILAMENT

This invention relates to an incandescent electric lamp and more particularly to an incandescent lamp of the type having a means, such as a coating, for reflecting infrared (IR) energy back to the filament in order to increase its operating temperature. By increasing the operating temperature of the filament, the power required to maintain it at its operating temperature is decreased, thereby increasing the efficiency of the lamp.

Lamps of this general type have been proposed for many years. The principles behind such lamps are to make the lamp envelope of a fairly precisely designed optical shape, for example, a sphere. The envelope is provided with a coating to reflect the IR energy and the filament is sought to be precisely aligned at the optical center of the envelope so that substantially all of the IR energy will be reflected back to the filament after one reflection from the envelope wall.

In general, one of the problems encountered in manufacturing the lamp of the foregoing type is to precisely optically align the filament. This becomes difficult to do in high speed manufacturing processes using high speed equipment since, for example, the filament mounting leads are often mounted in glass which is somewhat difficult to work with and has a relatively poor dimensional stability. Also, the filament leads are not precise, either in their alignment or mounting. In addition, it is difficult to maintain precise alignment in handling during shipping, in installation and in use subsequent to manufacturing. For these reasons, among others, it has not been possible to produce a lamp that maintains an optically centered filament during its life on an economical commercial basis. In the case where a lamp is designed for the filament to be optically aligned, filament misalignment lowers the luminous output of lamps and their output is unstable against misalignment.

The present invention avoids some of the aforesaid manufacturing and stability problems by producing a lamp of the type having a means for reflecting the IR energy in which the filament is deliberately misaligned with respect to the optical center of the envelope. The lamp operates on the principle that, while not being as efficient as a lamp in which the filament is precisely optically aligned, it produces a higher efficiency than a conventional incandescent lamp and is quite efficient with respect to energy saving. In accordance with the invention, the filament is deliberately misaligned in the envelope so that the IR energy which is reflected will impinge back on the filament after two passes, or reflections, from the envelope wall. While the final operating temperature of the filament is somewhat lower than that which would be encountered if the filament was precisely optically centered, this is compensated for during the design of the filament by making it consume somewhat more power than a filament which would be precisely optically aligned to operate at the desired temperature.

It is therefore an object of the present invention to provide an incandescent electric lamp having a means thereon for reflecting IR energy back to its filament in which the filament is deliberately misaligned with respect to the optical center of the envelope.

A further object is to provide an incandescent electric lamp in an envelope having a coating thereon for reflecting IR energy in which the filament is located off of the optical center of the envelope.

Other objects and advantages of the present invention will become more apparent upon reference to the following specification and annexed drawings in which.

Figure 1:
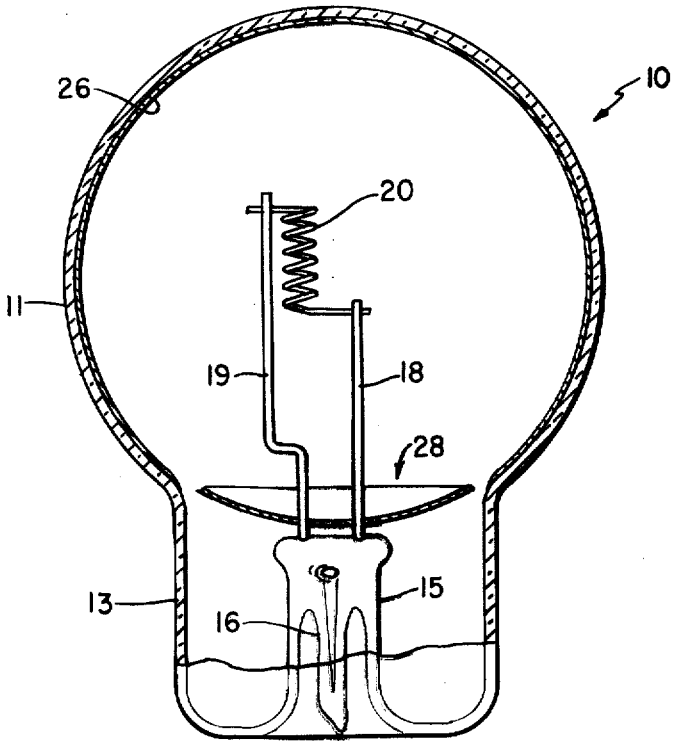
FIG. 1 is an elevational view of an electric lamp made in accordance with the present invention.

Referring to FIG. 1, the incandescent lamp 10 of the invention includes an envelope 11 of glass, such as lime glass or borosilicate glass or other similar material. The envelope is shown as being generally spherical in shape, although other optical design shapes can be used, for example, an ellipsoid, depending upon the shape and placement of the filament. The envelope is shaped as a spherical lens so that it is capable of reflecting IR energy incident on its wall, both to an image point.

The envelope 11 has a neck portion 13 which is formed with a reentrant stem 15 having a tubulation 16 therein. The interior of the envelope 11 is exhausted through the tubulation 16 and then filled with a gas, if this is desired. The lamps of the present invention can operate either as vacuum-type or as a gas filled lamp, for example filled with argon or some other conventional type of gas used with incandescent lamps. A high molecular weight gas such as krypton also can be used.

Extending from the stem 15 is a pair of lead-in wires 18,19, these wires being relatively stiff. The bottom ends of the wires are connected to a base of conventional construction, for example, of the screw type or of the bayonet type to make electrical contact therewith, the base being able to be placed into a socket. The base is not shown for purposes of clarity.

A filament 20 is mounted to the lead-ins 18 and 19. The filament preferably has a high emissivity, in the order of 0.5 or better and it is made of tungsten, doped or plain, or other suitable refractory material. The filament is shown as being vertically mounted. However, it can be mounted in other directions and can have other shapes.

The envelope is preferably coated throughout with a material 26 which is one which is both highly reflective to IR energy and also highly transmissive to visible energy. The coating 26 can be located either on the inside or the outside of the envelope although the inside is preferred. It is preferred that the coating transmit as much of visible and reflect as much IR energy as possible. Typical transmissivities (T) are in the order of 60% or greater of the visible energy incident from the filament or better and typical IR reflectivities (R) are also of the order of 60% or greater of the energy produced by the filament.

The coating 26 is preferably of a type which is set forth in the copending application Serial No. 781,355 now U.S. Pat. No. 4,160,929 granted July 10, 1979 and comprises three discrete layers, two layers of a dielectric material which sandwich a metal therebetween. In the aforesaid copending application, the coating material was $TiO_2/Ag/TiO_2$ although other metals and dielectrics can be used. In general, the metal is of a type whose index of refraction is mainly imaginary, typical metals of this type being silver, gold, aluminum and the alkalai metals. Another suitable coating is described in my copending application Ser. No. 863,155 which comprises two layers of a metal, such as silver, sandwiching a dielectric material therebetween to form a so-called Etalon coating.

Considering now the operation of the lamp, when current is supplied to the lead-ins 18,19, the filament will incandesce. The incandescence of the filament requires an electrical energy input per unit time (wattage) which is in accordance with certain design characteristics, including the temperature at which the filament is supposed to operate. For a given line voltage the filament is designed with a resistance so that it will consume an amount of current needed to produce the desired operating temperatures. Typical operating temperatures for an incandescent lamp are in the range from about 2700° K. to about 3,000° K. In a conventional envelope without a coating such as 26, that is, one in which there is no IR energy reflected, the filament is designed for this operating temperature without regard to reflected IR energy. In the design of the filament 20 in the lamp with an IR reflective coating, the selected operating temperature is in part maintained by the reflected IR energy which impinges on the filament. The amount of this reflected energy is a function of the efficiency (IR reflectivity) of the coating. Thus, in designing the filament for an IR reflector type lamp, the desired operating temperature can be achieved by designing the resistance to produce a lower electrical energy input and then add to this the additional heat energy contributed by the IR reflection.

Figure 2:
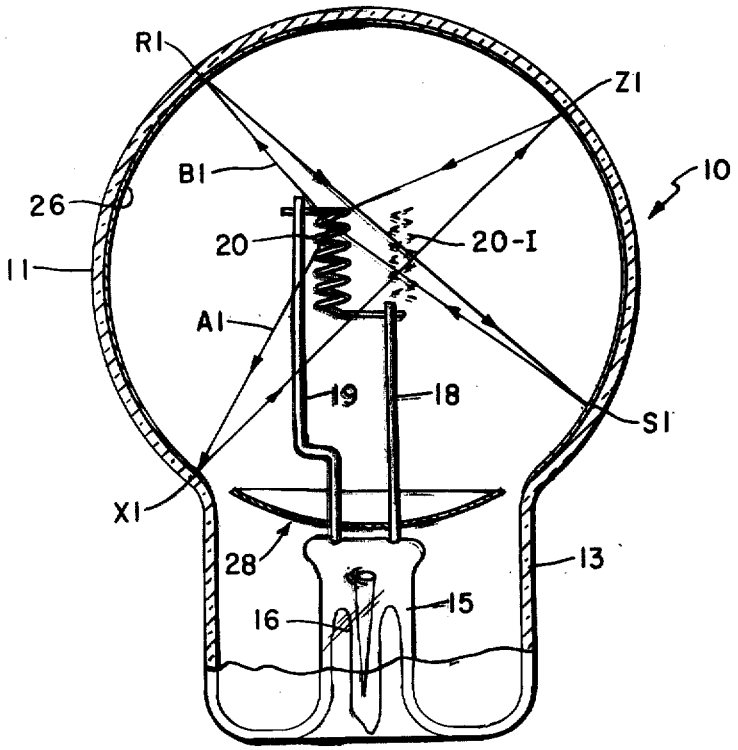
FIG. 2 is a section view of the lamp of FIG. 1 taken showing the reflected rays.

If the filament 20 is precisely at the optical center of the envelope, all of the IR energy which impinges upon the envelope, minus that which is absorbed by or transmitted through the envelope, will be reflected back to the filament. As a practical matter, as explained previously, for various reasons it is difficult to precisely optically center the filament. Accordingly, in accordance with the subject invention, the filament is located off-center of the optical center of the envelope. Referring to FIG. 2, this illustrates the operation of the lamp with the filament off-center. The filament 20 is shown diagrammatically and, since it is off the optical center of the envelope, it has an image which is designated as 20I. Since the envelope 11 is generally spherical, it acts as a spherical lens. Thus, any ray of IR energy originating from any point of the filament will return to the same point of the filament after, generally, only two reflections from the coating 26. That is, any ray from the off-center filament 20 is first reflected from the wall, passes through the image 20-I, and is reflected again from the wall back onto the filament. Thus, as compared to the case where the filament is precisely on center, the IR energy which returns to the off-center filament will have slightly less energy since somewhat more will be absorbed and/or transmitted by the coating 26 and the envelope during the two reflections.

Referring again to FIG. 2, the operation of the lamp is illustrated by considering a ray designated A1 which originates from a point near the top end of the filament 20. This impinges on the coated envelope wall at point X1, passes through the bottom point of the image 20I of the filament at point Y1, is reflected from the other side of the envelope wall at point Z1 and then returns to the filament 20 at the point where it originated. A ray B1 originating from the same point on the filament going in a different direction impinges upon the wall at point R1, passes through an image point on image 20I in making a trip across the envelope to point S1 and then returns to the origin point on the filament 20. A similar analysis would hold for substantially every other point on the filament except for those rays which are emitted into a direction which is into the base area and stem area 15. To reflect these rays, a reflector 28, which can be of silver or other highly IR reflective material, is preferably placed at the bottom of the envelope (see FIG. 1) to try to more fully complete the generally spherical surface of the envelope and to reflect the IR energy back onto the filament.

By an off-center design, it is preferred that the filament be at least a distance of about 1.0–2.0 diameters of the filament away from the optical center and no more than about 5.0 diameters. A filament located within this range of distances from the optical center will operate satisfactorily. A filament can fairly easily be located within this distance range as compared to attempting to purely optically center it.

The advantages of the lamp of FIG. 1, with the deliberately misaligned off-center filament can be analyzed by looking at the lamp both from the point of view of operation at constant power (designed for a particular wattage operation) or one designed for a constant voltage. Three cases which will be considered are lamps which have a filament which is precisely optically centered, one which is designed for precisely optical center but in which the filament is accidentally misaligned, and one, according to the invention, wherein the filament is deliberately misaligned.

REDUCTION IN LIGHT OUTPUT WHEN OFF CENTER

The total infrared emission, $P_{IR}$, in an IR coated envelope is given by:

$$P_{IR} = \frac{(1 - R^i_{IR})}{[1 - (1 - E)R^i_{IR}]} P^o_{IR}(T) \equiv S^{(i)}_{IR} P^o_{IR}(T) \quad (1)$$

where $P_{IR}{}^o(T) = A\epsilon\sigma T^4 f_{IR}$: radiation emission, in a bare envelope, of a filament of enclosure area, A, effective filament emissivity, $\epsilon$, temperature T and fraction of radiation in infrared, $f_{IR}(T)$. The constant $\sigma$ is $5.679 \times 10^{-12}$ in watts per square centimeter per (degree Kelvin)$^4$.

$R_{IR}{}^i = R_{IR}{}^1 = R_{IR}$, if perfectly aligned filament, so that there is only 1 pass to return to filament.

$R_{IR}{}^i = R_{IR}{}^2$, if misaligned slightly so that the emitted energy misses the filament and must make two passes to return to filament.

$R_{IR} = R_{FILM}{}^{IR} R_{OTHER}$, fraction of radiation from filament that images at focus of lamp, where $R_{FILM}{}^{IR}$ is the reflectivity of the coating to IR energy and $R_{OTHER}$ is the fraction of radiation lost by all other processes including scattering by the mount structure and by imperfections in the envelope.

$S^{(i)}$: fraction of bare power required in on center (i=1) of off center (i=2) operation.

The total visible emission, $P_{VIS}$, is given by equation (1) but with $f_{IR}(T)$ replaced by $f_{VIS}(T)$ and $R_{FILM}{}^{IR}$ replaced by $R_{FILM}{}^{VIS}$. Any variation in emissivity $\epsilon$ in the visible and IR ranges can be included. Equation (1) accounts for losses including absorption and scattering. However, the luminous emission comes only from that visible light which is transmitted through the coating of transmissivity, $\tau$. The light emission through the envelope is:

$$P_{light} = \frac{\tau_{vis}}{[1-(1-E)R_{vis}]} P_{vis}(T); \text{ on center} \quad (2)$$

$$P_{light} = \frac{\tau_{vis}(1-R_{vis})}{[1-(1-E)R_{vis}^2]} P^{o}_{vis}(T); \text{ off center} \quad (3)$$

The total input power, P, goes into total visible, total IR and heat power output so that $P = P_{VIS} + P_{IR} + P_{HEAT}$.

The watts input, visible lumens, lumens per watt and wattage saving over an uncoated lamp can be calculated as a function of filament temperature for three cases:

(a) filament on center in a lamp designed for on center operation;

(b) filament purposely off center in a lamp designed for off center operation;

(c) filament accidently off center in a lamp designed for on center operation.

In a lamp designed for either on center or off center operation, the filament is designed to operate at a specific temperature when the input watts is supplemented by the IR energy returned in either on center or off center operation. When a lamp designed for on center operation has its filament accidently off center, case (c), the returned radiation must make two passes and is not sufficient to maintain filament temperature. The lower filament temperature that results reduces luminous output and the reduced temperature must be calculated.

In case (c), accidental off center operation results in the altered IR and visible power as given by:

$$S_{IR}^{(2)}P_{IR}(T) + S_{VIS}^{(2)}P_{VIS}(T) = P - P_{HEAT} \quad (4)$$

The input power, P, is fixed by design considerations for on center operation. When off center, $S_{IR}^{(2)}$ and $S_{VIS}^{(2)}$ increase and hence $P_{IR}$ and $P_{VIS}$ decrease so that temperature, T, drops. Equation (4) can be solved by using tables of $f_{IR}$ and $f_{VIS}$ versus temperature.

As an example, consider the case of an efficient design for on center operation in a krypton filled lamp which results in a 60% wattage reduction over a 100 watt bare lamp operating at 3000° K. Assume $R_{IR}=0.85$, $R_{VIS}=0.13$, $\tau_{VIS}=0.85$ and $P_{HEAT}=7$ watts, which last is assumed as independent of designed filament temperature. When the temperature falls in off center operation, the heat loss drops because the temperature above ambient (T-300° K.) decreases. With these assumptions, Eq (4) becomes $$0.41\, P_{IR}(T) + 0.99\, P_{vis}(T) = P - 7\left(\frac{T-300}{T_D-300}\right)$$

$T_D$: designed filament temperature. For the conditions mentioned, it is found that the temperature decrease upon accidental off center operation is substantially independent of designed filament temperature and amounts to an approximately 250° K. drop in temperature. This temperature decrease results in a large decrease in luminous output and wattage saving when a lamp designed for on center operation accidentally finds the filament off center because of misalignment in manufacturing or subsequent handling and use. A movement of the filament by one filament diameter initiates this loss of output. Thus on center output is unstable against very small changes in filament position.

To achieve the same operating temperature in a lamp designed for purposely off center operation (case b), additional power must be applied to the lamp compared to a lamp designed for on center operation (case a). To do this, the filament resistance is made somewhat lower than for a lamp designed for on center operation. In a lamp designed for off center operation, further misalignment usually leaves the filament still off center, producing little change in output. A lamp designed for off center operation is very stable against filament misalignment.

Values of the operating characteristics of the cases (a), (b) and (c) can be determined using the above equations. A lamp with deliberately off center operation (b) is, of course, not quite as efficient as one with on center operation (a), but it is far superior to the latter lamp when misalignment occurs (c). A similar mathematical treatment can be done using a constant voltage parameter, instead of constant voltage, in each of the three cases.

As indicated by the above analysis, the filament design in an IR reflective coating lamp with the filament deliberately misaligned off center is different from the case when the filament is precisely aligned. If desired, the off center lamp can be designed to have a lower operating temperature and, therefore, a longer life. In a lamp designed for a deliberately off center filament a minority of the misalignments will accidentally place the filament on center. The filaments in lamps with these small numbers of misalignments will operate at a higher temperature than originally designed for. These lamps will have a higher than designed for efficiency but will also have a shorter than designed for life more typical of the life of commonly manufactured lamps.

Figure 3:
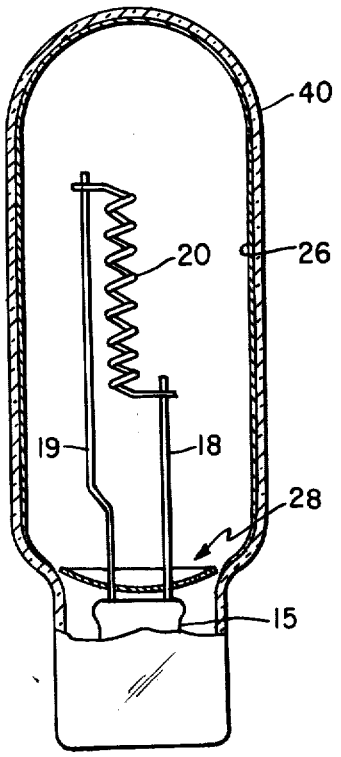
FIG. 3 is an elevational view of another embodiment of lamp.

FIG. 3 illustrates the invention as applied to a lamp having a generally cylindrical envelope 40. In a lamp envelope of this type, the problems of accurately centering a filament are even more severe than in a spherical envelope. Here again, the filament 20 is mounted off center by about at least 1.0 diameters. The maximum off center distance is preferably somewhat less than that in a spherical envelope, for example, about 3.0–3.5 diameters. Here, IR rays emanating radially from filament 20 impinge back on the filament after two passes in the manner previously described since the envelope operates as cylindrical lens. Rays originating in other directions will generally make more than two passes since they will impinge on either the top wall of the envelope or on reflector 28. Rays originating off the ends will be reflected directly back by the top wall and/or reflector.

Figure 4:
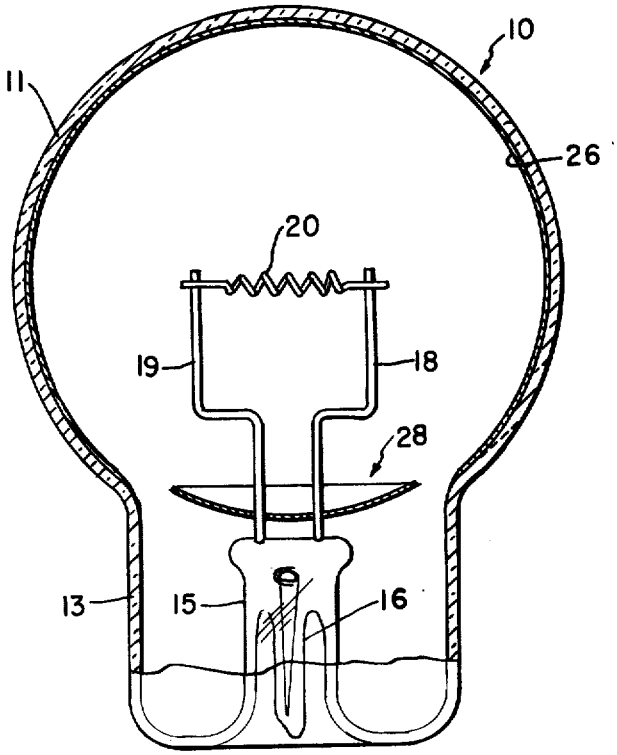
FIG. 4 shows a lamp with a filament mounted horizontally to the base.

FIG. 4 shows a modification of the lamp of FIGS. 1–2. Here, the filament is mounted horizontally with respect to the base instead of vertically. The lamp operates as described for FIGS. 1–2 and the IR reflection pattern is basically the same. However, the lamp is somewhat less efficient since IR energy emitted radially of the filament has a somewhat greater tendency to be lost in the area of reflector 28.

What is claimed is:

1. An incandescent electric lamp comprising:

an envelope having a curved surface portion, filament means mounted within said envelope, means for supplying electrical current to said filament to cause it to incandesce to emit energy in both the visible and infrared ranges, means on substantially the entire curved surface portion of said envelope for reflecting at least an average in excess of about 60% of the energy over the infrared range produced by said filament incident thereon and for transmitting therethrough an average in excess of about 60% of the visible range energy incident thereon produced by said filament, said envelope having the major part of the curved surface portion optically shaped for the infrared energy reflecting means to reflect infrared energy from the filament incident thereon back toward said filament, each part of said filament being deliberately located outside of the direct optical image of the filament formed by the curved surface reflecting portion of the envelope such that a substantial portion of the infrared energy emitted by a respective part of the filament returns to said part after at least two reflections from the envelope to raise the operating temperature of the filament with the major portion of the visible energy being transmitted through said infrared energy reflecting means on the first incidence thereon in accordance with the transmissivity to visible range energy of said reflecting means.

2. An incandescent electric lamp as in claim 1 wherein said infrared energy reflecting means comprises a coating.

3. An incandescent electric lamp as in claim 1 wherein said envelope has a base portion, said filament means is elongated and mounted generally vertically with respect to said base portion of said envelope.

4. An incandescent electric lamp as in claim 1 wherein said envelope has a base portion, said filament means is elongated and mounted generally horizontally with respect to said base portion of said envelope.

5. An incandescent electric lamp as in claim 1 wherein said curved surface portion of the envelope for reflecting the infrared energy is shaped as a spherical lens.

6. An incandescent electric lamp as in claim 1 wherein the curved portion of the envelope for reflecting the infrared energy is shaped as a cylindrical lens.

7. An incandescent electric lamp as in claim 1 wherein said filament means is of a given diameter, the filament means being located off of the optical image axis of the reflecting portion of the envelope by a distance of from about 1.0 to about 5.0 diameters of the filament means.

8. An incandescent electric lamp as in claim 7 wherein said distance is between about 1.0 and 3.5 diameters.

9. An incandescent electric lamp as in claim 2 wherein said coating is formed of a metal whose index of refraction is substantially imaginary and at least one layer of dielectric material adjacent thereto.

10. An incandescent electric lamp as in claim 1 wherein the filament means is designed to consume a higher power to achieve a predetermined operating temperature than a filament located on the optical image axis designed to achieve the same predetermined operating temperature.

11. An incandescent electric lamp as in claim 1 wherein said optically shaped envelope curved portion is spherical and the infrared energy is reflected back to the filament after only two reflections from said infrared energy reflecting means.

* * * * *